US010469940B2

(12) United States Patent
Taylor et al.

(10) Patent No.: US 10,469,940 B2
(45) Date of Patent: Nov. 5, 2019

(54) VALVE FOR ACOUSTIC PORT

(71) Applicant: Apple Inc., Cupertino, CA (US)

(72) Inventors: Martin D. Taylor, Portola Valley, CA (US); Hongdan Tao, Sunnyvale, CA (US); Claudio Notarangelo, San Jose, CA (US); Suzanne C. Brown, San Jose, CA (US); Benjamin J. Pope, Mountain View, CA (US); Scott P. Porter, Inglewood, CA (US); Tang Y. Tan, San Francisco, CA (US); Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/499,775

(22) Filed: Apr. 27, 2017

(65) Prior Publication Data

US 2018/0091892 A1 Mar. 29, 2018

Related U.S. Application Data

(60) Provisional application No. 62/399,160, filed on Sep. 23, 2016.

(51) Int. Cl.

| | |
|---|---|
| ***H04R 29/00*** | (2006.01) |
| ***H04R 1/28*** | (2006.01) |
| ***H04R 3/00*** | (2006.01) |

(52) U.S. Cl.

CPC ..... *H04R 1/2826* (2013.01); *H04R 1/2811* (2013.01); *H04R 3/00* (2013.01); *H04R 29/001* (2013.01); *H04R 2499/11* (2013.01)

(58) Field of Classification Search

CPC ..... H04R 1/1041; H04R 1/1083; H04R 2460/00; H04R 2460/15; H04R 2460/11;

(Continued)

(56) References Cited

U.S. PATENT DOCUMENTS

| | | | |
|---|---|---|---|
| 3,432,622 | A | 3/1969 | Sebesta et al. |
| 5,694,475 | A | 12/1997 | Boyden |

(Continued)

FOREIGN PATENT DOCUMENTS

| | | |
|---|---|---|
| CN | 202178856 | 3/2012 |
| EP | 2134107 | 12/2009 |

(Continued)

OTHER PUBLICATIONS

Apple Inc., Non-Final Office Action dated Jan. 26, 2015, U.S. Appl. No. 13/716,015.

(Continued)

*Primary Examiner* — Leshui Zhang

(74) *Attorney, Agent, or Firm* — Womble Bond Dickinson (US) LLP

(57) ABSTRACT

A portable electronic device including an enclosure having an enclosure wall that forms an interior chamber. A speaker module is positioned within the interior chamber and includes a speaker and a module wall forming a back volume chamber of the speaker. The back volume chamber includes an acoustic vent port formed through the module wall to acoustically couple the back volume chamber to the interior chamber. The device further including an electromechanical valve for regulating the acoustic coupling of the back volume chamber to the interior chamber. The electromechanical valve is operable to transition between an open configuration in which the acoustic vent port is open to the interior chamber and a closed configuration in which the acoustic vent port is closed off from the interior chamber.

19 Claims, 8 Drawing Sheets

(58) Field of Classification Search

CPC . H04R 3/00; H04R 3/007; H04R 3/02; H04R 3/04; H04R 3/06; H04R 3/08; H04R 3/10; H04R 29/00; H04R 29/01; H04R 29/02; H04R 29/03; H04R 2499/10; H04R 2499/11; H04R 2499/15; H04R 1/20; H04R 1/245; H04R 1/403; H04R 1/26; H04R 1/323; G10K 11/7827; G10K 11/1783; G10K 11/17833; G10K 11/17835; G10K 11/17837; A61F 2011/145; H04B 5/00; H04B 5/006; H04B 3/00; H04M 1/03; H04M 1/605

USPC ..... 381/386, 387, 393, 395, 333–336, 59; 455/575, 90, 347, 351, 100, 575.1, 90.1; 379/428, 430, 433; 700/94

See application file for complete search history.

(56) References Cited

U.S. PATENT DOCUMENTS

| | | | | |
|---|---|---|---|---|
| 5,790,679 | A * | 8/1998 | Hawker | H04M 1/0202 379/388.02 |
| 6,002,949 | A * | 12/1999 | Hawker | H04M 1/0202 361/814 |
| 6,466,681 | B1 | 10/2002 | Siska, Jr. et al. | |
| 6,853,735 | B2 | 2/2005 | Imahori et al. | |
| 7,206,425 | B2 | 4/2007 | Vaudrey et al. | |
| 7,861,723 | B2 | 1/2011 | Dedrick et al. | |
| 8,098,854 | B2 | 1/2012 | van Halteren et al. | |
| 8,113,482 | B2 | 2/2012 | Hunnicutt | |
| 8,340,310 | B2 | 12/2012 | Ambrose et al. | |
| 8,548,186 | B2 | 10/2013 | Alwicker et al. | |
| 8,761,432 | B1 | 6/2014 | Cheng | |
| 8,798,304 | B2 | 8/2014 | Miller et al. | |
| 9,185,480 | B2 | 11/2015 | Howes et al. | |
| 2007/0040231 | A1 | 2/2007 | Harney et al. | |
| 2010/0099394 | A1* | 4/2010 | Hainzl | G06F 1/32 455/418 |
| 2010/0322454 | A1 | 12/2010 | Ambrose et al. | |
| 2011/0110550 | A1 | 5/2011 | Bharatan et al. | |
| 2011/0261986 | A1 | 10/2011 | Murayama | |
| 2012/0057734 | A1 | 3/2012 | Ambrose et al. | |
| 2014/0133687 | A1 | 5/2014 | Lee | |
| 2014/0169579 | A1* | 6/2014 | Azmi | G10K 11/16 381/71.6 |
| 2014/0169585 | A1* | 6/2014 | Howes | H04R 1/086 381/91 |
| 2014/0205131 | A1 | 7/2014 | Azmi et al. | |
| 2015/0110335 | A1 | 4/2015 | Telemaque et al. | |

FOREIGN PATENT DOCUMENTS

| | | | |
|---|---|---|---|
| EP | 2134107 | | 7/2012 |
| EP | 2747455 | | 6/2014 |
| EP | 2747455 | | 12/2014 |
| GB | 1057853 | A | 2/1967 |
| JP | 2004153675 | A | 5/2004 |
| JP | 2006304021 | | 11/2006 |
| JP | 2009044687 | A | 2/2009 |
| JP | 2009302800 | | 12/2009 |
| JP | 2009545369 | T | 12/2009 |
| JP | 2010014279 | A | 1/2010 |
| WO | WO2008016403 | A1 | 2/2008 |
| WO | WO-2010042613 | | 4/2010 |
| WO | WO2016029378 | A1 | 3/2016 |

OTHER PUBLICATIONS

Apple Inc., PCT Search Report and Written Opinion (dated May 18, 2016), International Application No. PCT/US2016/016641, International Filing Date—Feb. 4, 2016, 13 pages.

Borges, Renata C. , et al., "An Adaptive Occlusion Canceller for Hearing Aids", Universidade Federal de Santa Catarina—Florianpolis, Brazil, EUSIPCO, 2013, (2013), 5.

Apple Inc., Extended European Search Report dated Feb. 15, 2018, EP Application No. 17186745.

Notice of Preliminary Rejection (Non-Final) dated Jul. 12, 2018, Korean Patent Application No. 10-2017-0106563.

Apple Inc., First Examination Report dated Jun. 6, 2018, Australian Application No. 2017218935.

Full Australian Examination Report dated Oct. 29, 2018, for related Australian PCT Appln. No. 2017218935 4 Pages.

Japanese Office Action dated Oct. 5, 2018, for related Japanese Appln. No. 2017-159105 4 Pages.

European Search Report dated Jun. 27, 2019, for related European Appln. No. 19162349.5 6 Pages.

* cited by examiner

VALVE FOR ACOUSTIC PORT

CROSS-REFERENCE TO RELATED APPLICATION

This application claims the benefit of the earlier filing date of U.S. Provisional Patent Application No. 62/399,160, filed Sep. 23, 2016 and incorporated herein by reference.

FIELD

An embodiment of the invention is directed to an acoustic transducer having a valve, more specifically a speaker with a valve for regulating an acoustic coupling of the speaker back volume chamber to a chamber surrounding the speaker. Other embodiments are also described and claimed.

BACKGROUND

Portable communications devices (e.g., smart phones) have within them one or more speakers that convert an input electrical audio signal into a sound pressure wave output that can be heard by the user. The speakers can be used to, for example, output sound pressure waves corresponding to the voice of a far end user, such as during a telephone call, or to output sound pressure waves corresponding to sounds associated with a game or music the user wishes to play. Due to the relatively low profile of cellular devices, the speakers also have a relatively low profile, which in turn, can make it difficult to maintain a speaker back volume chamber which allows for maximum sound output in the low frequency ranges. For example, a change in the size of the internal volume of the device housing (such as when a user presses on the device), can have an impact on the speaker within the housing (e.g., increase a surrounding pressure on the speaker), and in some cases, the associated sound output.

SUMMARY

An embodiment of the invention is directed to a piezo actuated valve for isolating a back volume of a speaker module. The actuated valve allows for the device to be used in two discrete modes. The first mode allows the device to take advantage of an unused volume inside the device enclosure within which it is positioned (e.g., a portable communications device enclosure) for improved bass-frequency response when taking a call (e.g., the speaker is in the receiver mode). The second mode isolates the speaker in a smaller back volume which protects it from changes in pressure due to, for example, a pressure on the device enclosure (e.g., the speaker is in a speaker mode for game play).

Representatively, in one embodiment, the invention is directed to a portable electronic device including an enclosure having an enclosure wall that forms an interior chamber. A speaker module is positioned within the interior chamber and includes a speaker and a module wall forming a back volume chamber of the speaker. The back volume chamber may include an acoustic vent port formed through the module wall to acoustically couple the back volume chamber to the interior chamber. The device may further include an electromechanical valve for regulating the acoustic coupling of the back volume chamber to the interior chamber. The electromechanical valve may be operable to transition between an open configuration in which the acoustic vent port is open to the interior chamber and a closed configuration in which the acoustic vent port is closed off from the interior chamber. The speaker may be in a receiver mode or a speaker mode, and the electromechanical valve transitions between the open configuration and the closed configuration based on whether the speaker is in the receiver mode or the speaker mode. For example, the electromechanical valve may be in the open configuration when the speaker is in the receiver mode and in the closed configuration when the speaker is in the speaker mode. In the receiver mode, the speaker may be closer to a user's ear than in the speaker mode. The device may further include a proximity sensor for detecting a proximity of the speaker to a user's ear, and the electromechanical valve may transition between the open configuration and the closed configuration based on the proximity of the speaker to the user's ear. The device may also include a pressure sensor for detecting a pressure input on the enclosure. The electromechanical valve may transition between the open configuration and the closed configuration based on the detection of the pressure input. The electromechanical valve may be in the open configuration when the pressure input is below a predetermined pressure input threshold value and transition to the closed configuration when the pressure input is above the predetermined pressure input threshold value. The electromechanical valve may be a piezoelectric valve. The electromechanical valve may be an electroactive polymer actuated valve.

In another embodiment, the invention is directed to a portable electronic device including an enclosure having an enclosure wall that forms an interior chamber, and the interior chamber is sealed from a surrounding environment outside of the enclosure wall. A speaker module may be positioned within the interior chamber. The speaker module may include a speaker and a module wall forming a back volume chamber of the speaker. The back volume chamber may include an acoustic vent port formed through the module wall to acoustically couple the back volume chamber to the interior chamber. The device may further include a valve for regulating the acoustic coupling of the back volume chamber to the interior chamber depending on whether the speaker is in a receiver mode or a speaker mode. In the receiver mode, the valve may be in an open configuration in which the acoustic vent port is open to the interior chamber and in the speaker mode the valve may be in a closed configuration in which the acoustic vent port is closed to the interior chamber. In some embodiments, the valve may be electromechanically actuated. For example, the valve may be a piezoelectric valve. Still further, the valve may include a piezoelectric member coupled to a valve flap by a flexure linkage, and the valve flap is aligned with the acoustic vent port. The application of a voltage to the piezoelectric member drives movement of the valve flap between an open configuration and a closed configuration, and in the open configuration, the valve flap does not cover the acoustic vent port, and in the closed position, the valve flap covers the acoustic vent port. In other embodiments, the valve may include an electroactive polymer that actuates the valve to move between the open configuration and the closed configuration. In still further embodiments, the valve may be bistable. In the receiver mode, the speaker is closer to a user's ear than in the speaker mode. The device may also include a proximity sensor to detect whether the speaker is in a receiver mode or a speaker mode based on a proximity of the speaker to a user's ear, and the valve transitions between an open configuration and a closed configuration based on the detection of the receiver mode or the speaker mode by the proximity sensor.

In another embodiment, a portable electronic device is disclosed and includes an enclosure having an enclosure wall that forms an interior chamber and a speaker module is positioned within the interior chamber. The speaker module may have a speaker and a module wall forming a back volume chamber of the speaker, and the back volume chamber includes an acoustic vent port formed through the module wall to acoustically couple the back volume chamber to the interior chamber. A valve for regulating the acoustic coupling of the back volume chamber to the interior chamber based on a pressure input to a portion of the enclosure wall may further be included. For example, the valve may transition between an open configuration in which it does not cover the acoustic vent port and a closed configuration in which it covers the acoustic vent port, and in the absence of the pressure input the valve is in the open configuration and the valve transitions to the closed configuration when the pressure input is detected. In some embodiments, the speaker is a micro-speaker.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
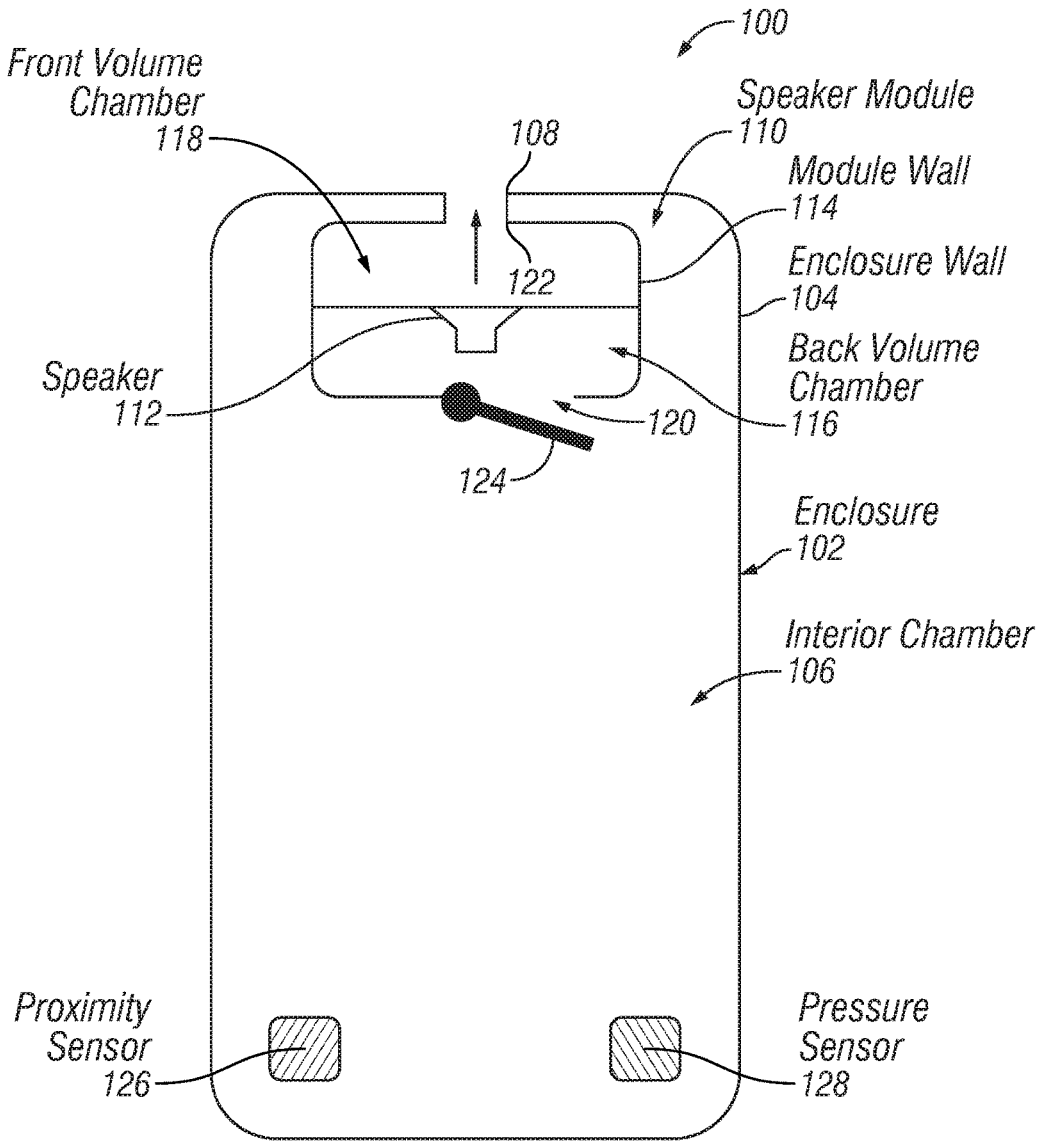
FIG. 1 illustrates a cross-sectional side view of one embodiment of a speaker positioned within a portable electronic device.

FIG. 1 illustrates a cross-sectional side view of one embodiment of a transducer positioned within a portable electronic device. The electronic device 100 may include a housing, casing or outer enclosure 102 that defines or closes off a chamber in which the constituent electronic components of electronic device 100, for example a portable or mobile communications device or portable time piece, are contained. Enclosure 102 may include an enclosure wall 104 that separates a surrounding environment from an encased space or interior chamber 106 formed within enclosure 102. In some cases, the enclosure wall 104 completely isolates or seals the interior chamber 106 from the surrounding environment. For example, the enclosure wall 104 may form a water-proof or acoustically isolated interior chamber 106 which is impermeable to water and /or air. The interior chamber 106 may be of a sufficient volume and/or size to accommodate the constituent components of electronic device 100. In addition, the interior chamber 106 may contain an unused volume of space that can be shared with other components (e.g., a speaker) within interior chamber 106, as will be described in the discussion that follows. The enclosure wall 104 may also include one or more of an enclosure acoustic port 108. The enclosure acoustic port 108 may be, for example, a sound output port through which sound from a speaker positioned within interior chamber 106 may be output. In other embodiments, where a microphone is positioned near enclosure acoustic port 108, it could be a sound input port to allow for input of sound to the microphone.

In this case, enclosure acoustic port 108 is a sound output port that is acoustically open to a speaker module 110 positioned within interior chamber 106. Representatively, speaker module 110 includes a module wall 114 that forms a chamber, casing, housing or inner enclosure within which speaker 112 is positioned. Speaker 112 may be any type of electroacoustic transducer capable of converting an electrical audio signal into a sound. In some embodiments, speaker 112 may be a micro-speaker, for example, a miniaturized version of a loudspeaker that uses a moving coil motor to drive sound output. Thus, in some embodiments, speaker 112 may be referred to herein as a micro-speaker. Speaker 112 may further be referred to herein as a speaker or receiver, depending on how it is being used. For example, in embodiments where device 100 is positioned near the ear of a user such that speaker 112 is used to output sound from a far-end user to the near-end user holding device 100 (e.g., during a telephone call), speaker 112 may be referred to as a receiver or as being used in receiver mode. In other embodiments where device 100 is positioned farther away from the user's ear and is, for example, being held in the user's hand for speaker phone usage, game play or listening to music, speaker 112 may be referred to as a speaker phone speaker or as being used in speaker mode. A proximity of device 100 to a user's ear, and in turn, the mode in which speaker 112 is being used, may be determined or otherwise detected using a proximity sensor 126 mounted within interior chamber 106. Proximity sensor 126 may be any type of sensor capable of detecting a distance of a target object (e.g., the user's ear or head) from device 100, and connected to corresponding circuitry within device 100 so that this information can be used to determine a proximity of device 100 to a user, and in turn, whether speaker 112 is in receiver mode (near the user's ear or head) or speaker mode (farther away from the user's ear or head than in receiver mode). Representatively, proximity sensor 126 may be a capacitive sensor, capacitive displacement sensor, optical sensor, or an inductive proximity sensor.

Returning now to the structure of speaker module 110, the enclosure formed around speaker 112 by module wall 114 may be divided into a front volume chamber 118 and a back volume chamber 116 around speaker 112. The front volume chamber 118 may form a chamber around the sound output face of speaker 112 and allow for sound from speaker 112 to pass to speaker acoustic port 122 (as illustrated by the arrow). Speaker acoustic port 122 is formed in module wall 114 and aligned with enclosure acoustic port 108 so that sound output from speaker 112 can pass through front volume chamber 118, to speaker acoustic port 122 and out of enclosure 102 via enclosure acoustic port 108, to the surrounding environment (e.g., to the user). Back volume chamber 116 surrounds the back side of speaker 112 and is acoustically sealed, or otherwise isolated from, front volume chamber 118. It is noted that any changes in size, volume and/or pressure of back volume chamber 116 may have an impact on the acoustic performance of speaker 112. For example, an increase in the size or volume of back volume chamber 116 could improve a low frequency response of speaker 112, while a decrease in the size or change in pressure of back volume chamber 116 could reduce or otherwise distort speaker performance.

With this in mind, speaker module 110 may further include an acoustic vent port 120 and associated valve 124 which can be used to regulate, or otherwise control, the characteristics (e.g., sizes, volume or pressure) of back volume chamber 116. Representatively, acoustic vent port 120 may be formed through a portion of module wall 114 defining back volume chamber 116 and be acoustically open to interior chamber 106 of enclosure 102. In other words, when acoustic vent port 120 is open as shown in FIG. 1, back volume chamber 116 shares a volume with interior chamber 106, and is therefore significantly increased. For example, in one embodiment, back volume chamber 116 may have a volume of 5 cc, and interior chamber 106 may have approximately 10 cc of interior volume or space. Thus, when acoustic vent port 120 is open to interior chamber 106, the volume of back volume chamber is effectively tripled, or around 15 cc. This in turn, will increase a frequency response of speaker 112 at low frequency. It is generally desirable for acoustic vent port 120 to remain open, thus is most cases, valve 124 will remain open and not cover or otherwise close back volume chamber 116 off from interior chamber 106. In some situations, however, it may be desirable to close acoustic vent port 120 using valve 124, and in turn, isolate back volume chamber 116 from interior chamber 106. For example, it may be desirable to isolate back volume chamber 116 from interior chamber 106 when a pressure within interior chamber 106 is unexpectedly increased, for example, due to a user pressing on a surface of enclosure 102 near speaker module 110. For example, when the user is holding device 100 in their hand away from the ear (e.g., using speaker 112 in speaker mode) and pressing on the cover glass. If back volume chamber 116 is not isolated from interior chamber 106, the pressure increase within interior chamber 106 could potentially increase a pressure within back volume chamber 116 (or otherwise change a size/volume of the back volume chamber), and, in turn, unintentionally distort the acoustic output of speaker 112. Thus, in such cases, valve 124 may be used to close acoustic vent port 120 and prevent the pressure change within interior chamber 106 from impacting speaker output. In some embodiments, this increase, or otherwise change in pressure, may be detected using any type of pressure sensor 128 (e.g., piezoelectric, capacitive, electromagnetic, optical, or the like) connected to associate processing circuitry, also positioned within interior chamber 106. In addition, it should be understood that acoustic vent port 120 is considered to be relatively large, for example, larger than a barometric relief port, such that in the open position, the two chambers are relatively open to one another (e.g., more open than in the case of a barometric relief port).

Valve 124 may be any type of valve capable of transitioning between an open position in which valve 124 does not cover acoustic vent port 120 (e.g., vent port 120 is open to interior chamber 106) and a closed position in which valve 124 covers acoustic vent port 120 (e.g., acoustic vent port 120 is closed to interior chamber 106). Representatively, in one embodiment, valve 124 may be an electromechanical valve 124 that uses an electrical signal (e.g., electric current) to drive or otherwise actuate valve 124 to move between the open and closed positions. Representatively, valve 124 may be a piezoelectric valve having a piezoelectric material (e.g., a piezoelectric ceramic) coupled to a valve flap as will be discussed in more detail in reference to FIGS. 3A and 3B. In other embodiments, valve 124 may include an electroactive polymer that changes in size or shape when an electrical input is applied. For example, the electroactive polymer may be a dielectric electroactive polymer, a ferroelectric polymer, an electrostrictive graft polymer, an ionic electroactive polymer, an electrorheological fluid, an ionic polymer-metal composite or a stimuli-responsive gel. Regardless of the particular electroactive or electrically actuatable material, however, it should be understood that because valve 124 is positioned between two substantially sealed, high pressure chambers (e.g., back volume chamber 116 and interior chamber 106), valve 124 is intended to be an "active" valve that can be automatically actuated by an electrical input, as opposed to, for example, a "passive" valve that is actuated by a direct pressure input or force on the valve itself. In addition, it is contemplated that in some embodiments, valve 124 may be a bistable valve that is stable in the open position and the closed position. For example, an initial short current or voltage input can transition valve 124 to an open position, and valve 124 remains in the open position until a second short current or voltage input is applied to transition valve 124 to the closed position. In other words, a constant electrical input is not required to keep valve 124 in either the open and closed position therefore an overall power consumption of device 100 is not significantly impacted by the operation of valve 124. In other embodiments, the application of a voltage may be used to open valve 124, and the removal of the voltage may cause valve 124 to close. In such embodiments, a capacitor may be integrated within the device to provide a continuous electrical input when necessary to keep valve 124 in the open position for extended periods of time.

Figure 2A:
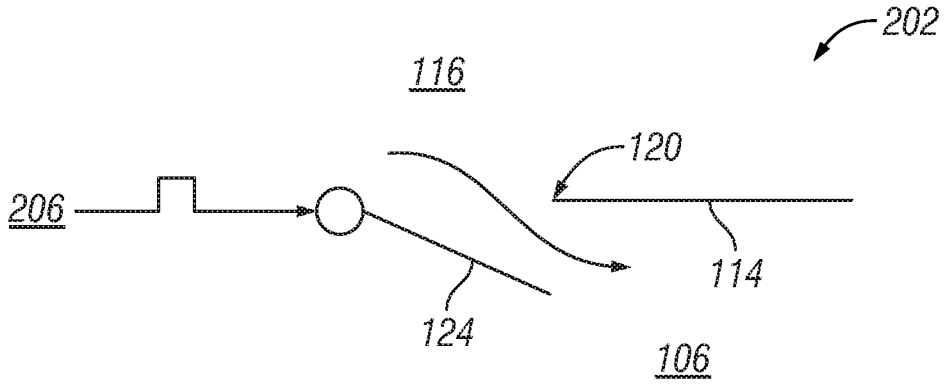
FIG. 2A illustrates a schematic diagram of the speaker of FIG. 1 and a valve in an open position.
Figure 2B:
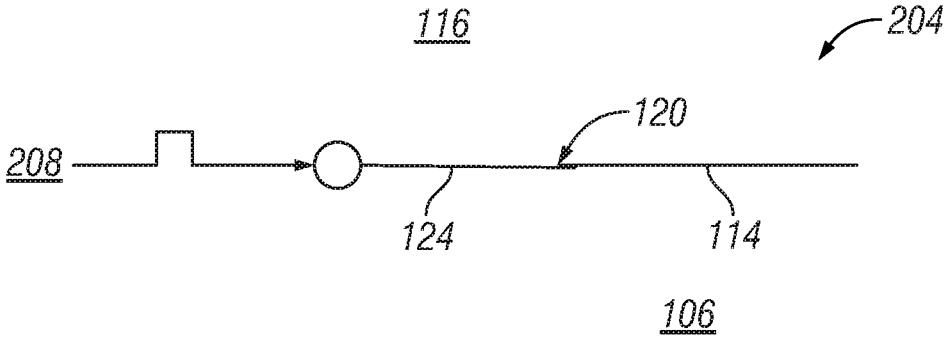
FIG. 2B illustrates a schematic diagram of the speaker of FIG. 1 and a valve in a closed position.

Referring now to FIG. 2A and FIG. 2B, FIG. 2A and FIG. 2B are schematic diagrams showing valve 124 associated with a current for transitioning valve 124 between the open position (e.g., FIG. 2A) and closed position (e.g., FIG. 2B). Representatively, FIG. 2A shows valve 124 in the open position 202 in which it does not cover acoustic vent port 120 and therefore acoustic vent port 120, and in turn back volume chamber 116, are open to the interior chamber 106 of the device enclosure. In the case of a bistable valve 124, valve 124 may be actuated, or otherwise caused to transition to the open position, by inputting a relatively short trigger or pulse electrical input 206 (e.g., a voltage) to valve 124, which causes valve 124 to move to the open position and remain in the open position indefinitely. FIG. 2B shows valve 124 upon application of a second pulse electrical input 208 that actuates, or otherwise causes valve 124, to move to the closed position 204 and cover acoustic vent port 120. In the closed position as shown in FIG. 2B, the back volume chamber 116 and interior chamber 106 of the enclosure are acoustically isolated from one another and therefore do not share a same enclosure volume.

Figure 3A:
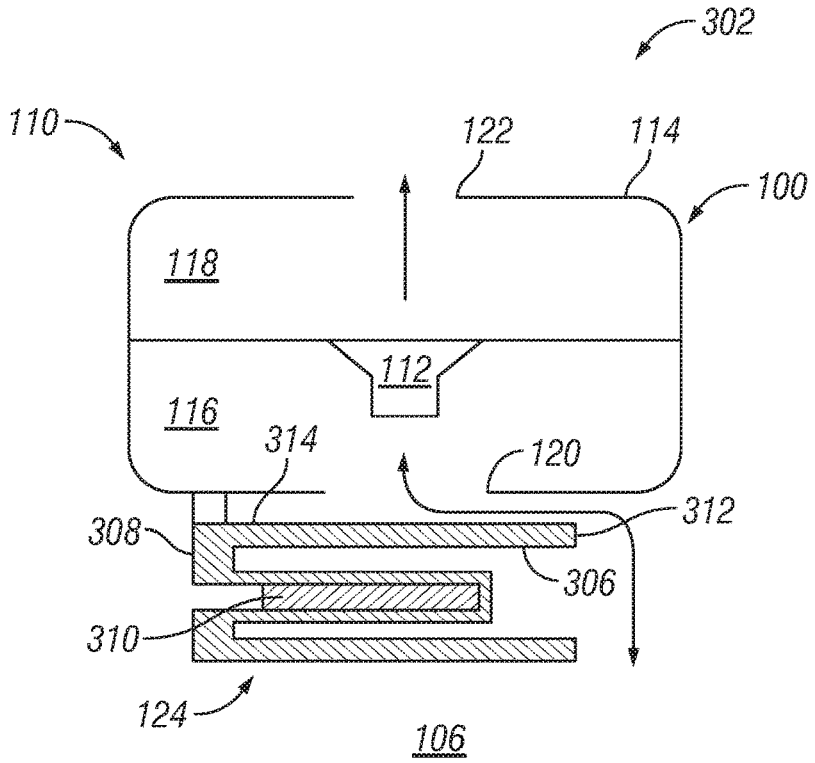
FIG. 3A illustrates a schematic diagram of one embodiment of a valve associated with the speaker of FIG. 1 in an open position.
Figure 3B:
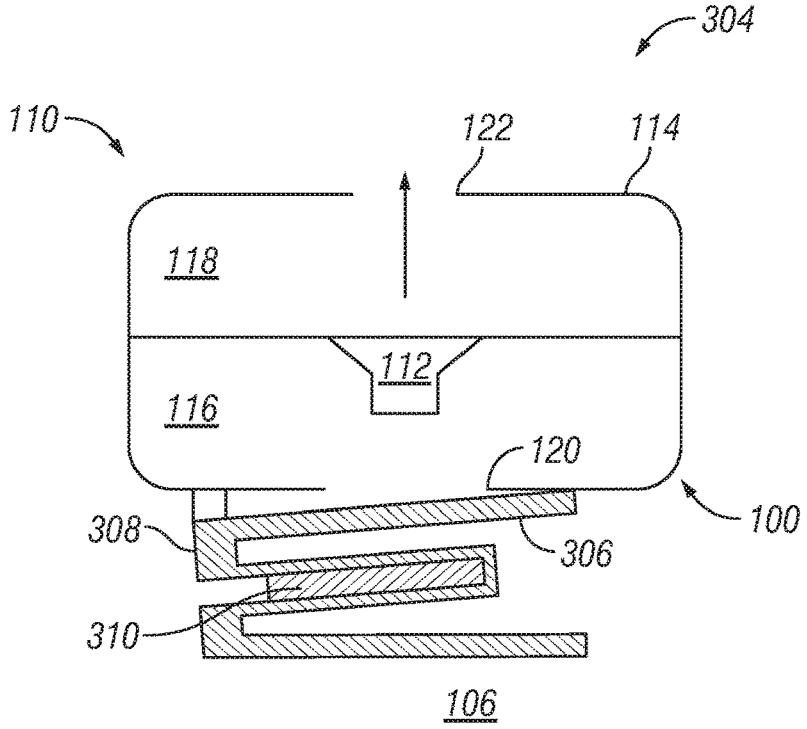
FIG. 3B illustrates a schematic diagram of one embodiment of a valve associated with the speaker of FIG. 1 in an closed position.

FIG. 3A and FIG. 3B illustrate schematic diagrams of one embodiment of the valve of FIG. 1 in an open position and a closed position, respectively. Representatively, FIG. 3A shows valve 124 in an open position 302 and FIG. 3B shows valve 124 in a closed position 304. It is noted that the various components of speaker module 110 previously discussed in reference to FIG. 1 are the same in FIG. 3A and FIG. 3B, and therefore are not repeated here. Specific details of one particular valve configuration, however, are shown in FIG. 3A and FIG. 3B. Representatively, in this embodiment, valve 124 includes a valve flap 306, a flexure linkage 308 and an electrically actuatable material 310. Valve flap 306 may be an elongated piece of material (e.g., metal) that is aligned with, and extends across, acoustic vent port 120. Valve flap 306 has one end that is considered a free end 312 that is not connected to any other structure, and another end 314 that is connected to a flexure linkage 308. The flexure linkage 308 is designed to cause valve flap 306 to move toward or away from acoustic vent port 120 upon actuation by actuatable material 310, depending on whether valve flap 306 is transitioning to the open or closed position. Actuatable material 310 may be an electroactive material such as a piezoelectric material. For example, actuatable material 310 may be a strip of a piezoelectric ceramic and/or aluminum based piezoelectric material which changes in size (e.g., expands/contracts) or shape (e.g., straightens/bends) upon input of an electric current as previously discussed. In other embodiments, actuatable material 310 may be an electroactive polymer, for example, a dielectric electroactive polymer, a ferroelectric polymer, an electrostrictive graft polymer, an ionic electroactive polymer, an electrorheological fluid, an ionic polymer-metal composite or a stimuli-responsive gel.

During operation, an electric current may be input to the actuatable material 310 (by circuitry integrated within device 100), which causes actuatable material 310 to change in size or shape. The change in size or shape of actuatable material 310 pulls valve flap 306 away from acoustic vent port 120 with the assistance of flexure linkage 308 so that there is a space between acoustic vent port 120 and valve flap 306. Acoustic vent port 120 is therefore open to interior chamber 106 as shown in FIG. 3A. When it is desired to close acoustic vent port 120, a further electric current can be input to actuatable material 310 to change actuatable material 310 back to a size or shape which causes valve flap 306 to move toward acoustic vent port 120 via flexure linkage 308 and cover acoustic vent port 120 as shown in FIG. 3B.

As previously discussed, in some embodiments, it is desirable to automatically transition valve 124 between the open and closed positions depending upon how the device 100 is being used. For example, if device 100 is in a receiver mode (e.g., near the user's ear), it may be desirable for valve 124 to be in an open position so that an acoustic output of speaker 112 in the low frequency range is maximized. Alternatively, if device 100 is being used in a speaker mode (e.g., farther away from the user's ear) and/or if the enclosure is being pressed by a user such that an unexpected pressure change is occurring within the interior chamber 106 that could distort speaker output, it may be desirable for valve 124 to be in a closed position. These exemplary modes of operation will now be discussed in reference to FIG. 4, FIG. 5 and FIG. 6.

Figure 4:
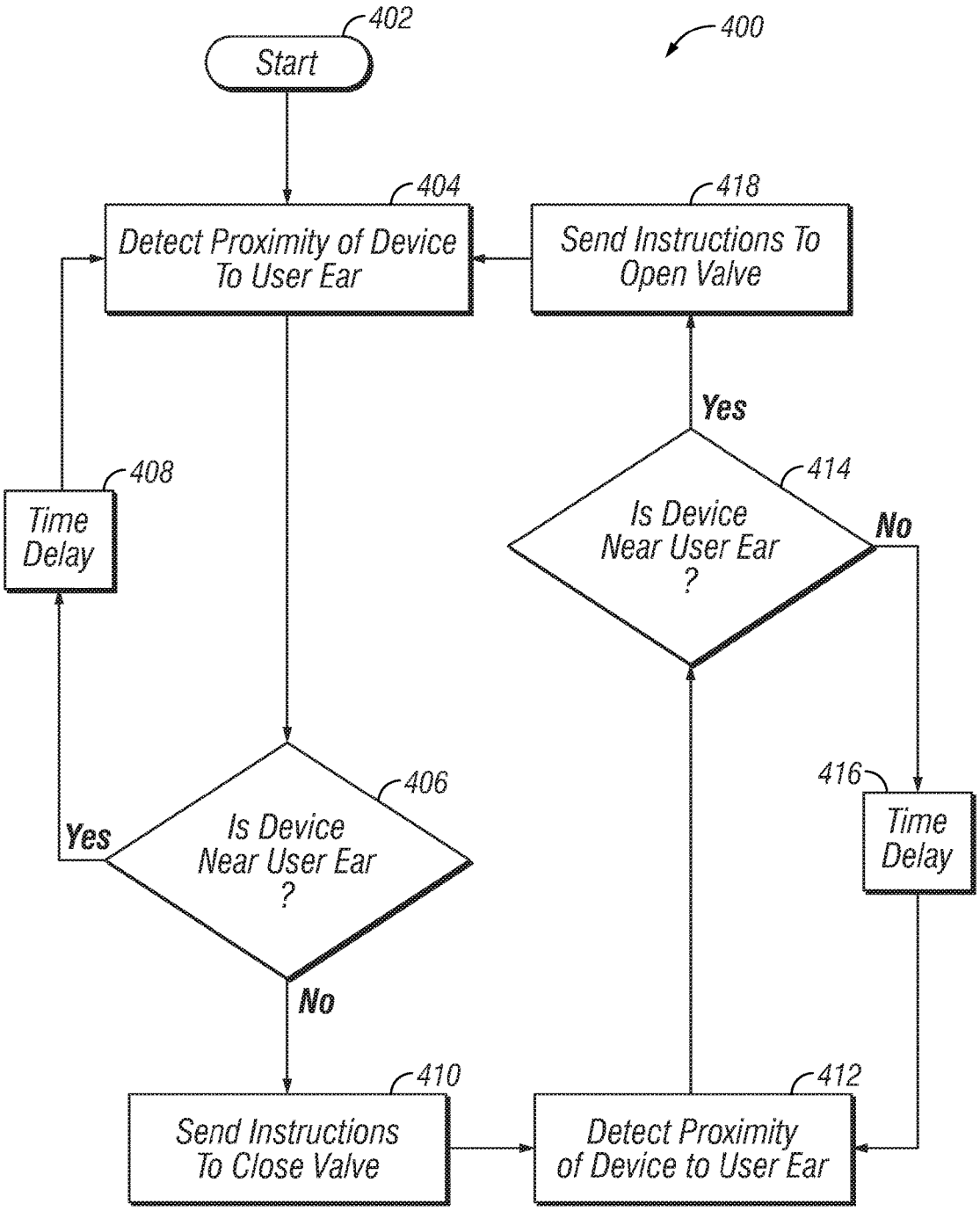
FIG. 4 is a simplified logic flow chart of an illustrative mode of operation for transitioning a valve between an open position and a closed position.

Representatively, FIG. 4 is a simplified logic flow chart of an illustrative mode of operation for transitioning a valve between an open position and a closed position based on a proximity of the device to a user's ear. In this embodiment, operation of the valve (e.g., valve 124) may include process 400 that represents one embodiment for a processing unit which determines when to open and close the valve. It should be understood that the processes discussed here and in the processes to follow are intended to be illustrative and not limiting. Persons skilled in the art can appreciate that steps of the processes discussed herein can be omitted, modified, combined, and/or rearranged, and any additional steps can be performed without departing from the scope of the invention.

Process 400 can start at step 402 and proceed to step 404. In step 404, a proximity of the device (e.g., device 100) to a user's ear is detected. The device proximity may be detected using a proximity sensor (e.g., proximity sensor 126) integrated within the device. The detected information can be received, for example, by a processor within the device which then uses the information to determine the location of the device with respect to the user. For example, in step 406, the processor can compare the information to predetermined proximity threshold data (or proximity threshold data determined by a user), and if based on the information, it is determined that the device is below the threshold (e.g., within a distance considered close to the user), the system can proceed to step 408. In step 408, process 400 can wait for a pre-determined time delay. After the pre-determined time delay, process 400 can return to step 404 and once again detect the proximity of the device to the user. Thus, process 400 can repeatedly loop through steps 404, 406 and 408 until it is detected that the device is above or outside of the predetermined proximity threshold and therefore considered far away from the user's ear (or head in general).

In response to the device not being near the user's ear (e.g., the device is far away from the user's ear), process 400 can proceed to step 410 and send instructions to close the valve, and isolate the speaker back volume chamber (e.g., back volume chamber 116) from the enclosure interior chamber (e.g., interior chamber 106). In such situations it may be desirable to close the valve and isolate the chambers because it suggests the device is being held in a position which may make it susceptible to conditions where speaker operations could be compromised. For example, the user may be holding the device in their hand for game play, which may expose the device to pressure changes due to the user pressing on the cover glass, which in turn can cause speaker distortion if the speaker back volume chamber is open to the interior chamber of the device. The instructions may, for example, be sent to a valve control unit located within the device.

After the valve is closed, process 400 can proceed to step 412 and can once again detect a proximity of the device to a user's ear. Steps 414, 416, and 418 can operate in the same manner as steps 404, 406 and 408 and can continue to loop and repeat, except since the valve is already closed, in step 418, instructions to open the valve are sent when it is determined that the device is near the user's ear in step 416. For example, in step 412 a proximity of the device to a user's ear (or head) can be detected. In step 414, process 400 can determine if the device is determined to be near the user's ear (or head). In response to the device not being near the user's ear or head, process 400 can proceed to step 416 and wait for a pre-determined time delay, and can then return to step 412. Thus, as long as it is determined that the device is far away from the user's ear, steps 412, 414 and 416 can continue to loop and the valve can remain closed. In response to it being determined that the device is near the user's ear in step 414, process 400 can proceed to step 418 and send instructions to open the valve. It is noted that when the device is near the user's ear, such as in a receiver mode during a telephone call, the speaker is less susceptible to events that could compromise speaker operation (e.g., the user pressing on the device), and therefore can remain open to the interior chamber of the device and benefit from a larger back volume and therefore enhanced performance at low frequency.

Process 400 can then return to step 404 and once again repeat steps 404, 406, and 408, until the device is determined to not be near a user's ear (e.g., be farther away from the user's ear). In this manner, process 400 can continuously monitor the proximity of the device to the user, and in turn, provide data for automatically transitioning valve between the open and closed positions. Process 400 can continue to operate as long as the system is on. For example, process 400 can continue to operate until the device is turned off.

Figure 5:
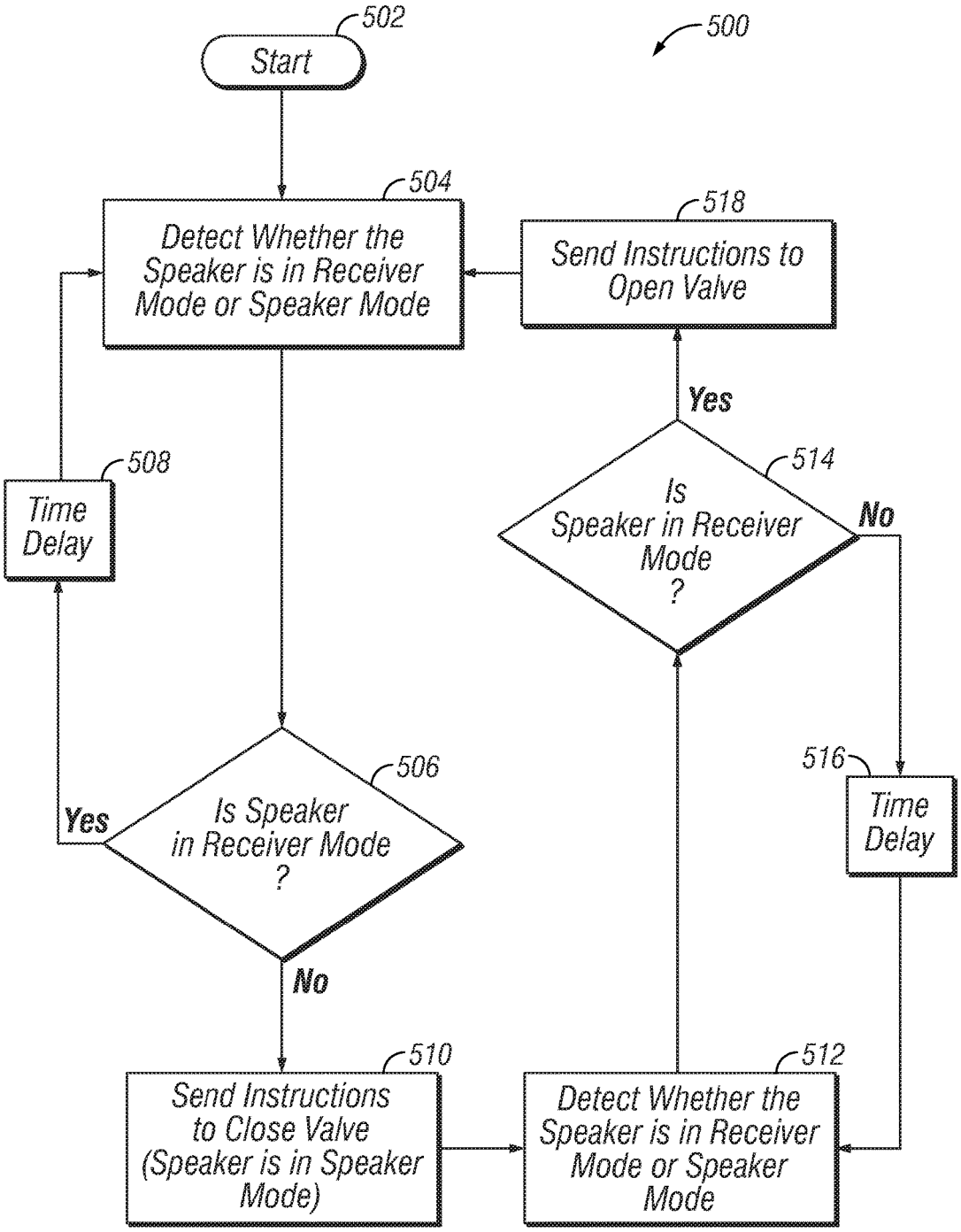
FIG. 5 is a simplified logic flow chart of another illustrative mode of operation for transitioning a valve between an open position and a closed position.

FIG. 5 is a simplified logic flow chart of an illustrative mode of operation for transitioning a valve between an open position and a closed position based on whether a speaker within the device is being used in a receiver mode or a speaker mode. In this embodiment, operation of the valve (e.g., valve 124) may include process 500 that represents one embodiment for a processing unit which determines when to open and close the valve.

Process 500 can start at step 502 and proceed to step 504. In step 504, a determination is made as to whether the speaker (e.g., speaker 112) within device (e.g., device 100) is in a receiver mode or a speaker mode. The speaker may be considered in a receiver mode when it is being held close to the user's ear, such as when the user is receiving a call, and may be considered in a receiver mode when the speaker is being held farther away from the ear, such as in the user's hand during game play or while listening to music. In this aspect, similar to process 400 previously discussed, whether the speaker is in receiver mode or speaker mode can be determined using a proximity sensor (e.g., proximity sensor 126) integrated within the device. The detected information can be received, for example, by a processor within the device which then uses the information to determine the location of the device with respect to the user, and in turn whether the speaker is being used in speaker mode or receiver mode. For example, in step 506, the processor can compare the information to predetermined proximity threshold data, and if based on the information, it is determined that the device, and in turn the speaker, is below the threshold (e.g., within a range considered close to the user), it determines that the speaker is in receiver mode, and the system can proceed to step 508. In step 508, process 500 can wait for a pre-determined time delay. After the pre-determined time delay, process 500 can return to step 504 and once again detect whether the speaker is in receiver mode or speaker mode. Thus, process 500 can repeatedly loop through steps 504, 506 and 508 until it is detected that the device is outside of the predetermined proximity threshold and therefore considered far away from the user's ear (or head in general), and therefore the speaker is being used in speaker mode. It should be noted that while in this embodiment, a proximity of the device is used to determine whether the speaker is in receiver mode or speaker mode, other data, for example speaker audio signals which may be different depending on whether the speaker is in receiver mode or speaker mode, may be used to determine whether to open or close the valve.

In response to the speaker being in speaker mode (e.g., not in the receiver mode), process 500 can proceed to step 510 and send instructions to close the valve, and isolate the speaker back volume chamber (e.g., back volume chamber 116) from the enclosure interior chamber (e.g., interior chamber 106). For example the instructions can be sent to a valve control unit located within the device.

After the valve is closed, process 500 can proceed to step 512 and can once again detect whether the speaker is in receiver mode or speaker mode. Steps 514, 516, and 518 can operate in the same manner as steps 504, 506 and 508 and can continue to loop and repeat, except since the valve is already closed, in step 518, instructions to open the valve are sent when it is determined that the speaker is in receiver mode step. For example, in step 512 whether the speaker is in receiver mode or speaker mode can be detected. In step 514, process 500 can determine if the speaker is in receiver mode (e.g., not in speaker mode). In response to the speaker not being in receiver mode, process 500 can proceed to step 516 and wait for a pre-determined time delay, and can then return to step 512. Thus, as long as it is determined that the speaker is not in receiver mode (e.g., is in speaker mode), steps 412, 414 and 416 can continue to loop and the valve can remain closed. In response to it being determined that the speaker is in receiver mode, process 500 can proceed to step 518 and send instructions to open the valve.

Process 500 can then return to step 504 and once again repeat steps 504, 506, and 508, until the speaker is determined to not be in receiver mode (e.g., in speaker mode). In this manner, process 500 can continuously monitor the speaker mode, and in turn, provide data for automatically transitioning the valve between the open and closed positions. Process 500 can continue to operate as long as the system is on. For example, process 500 can continue to operate until the device is turned off.

It should further be understood that while processes 400 and 500 discuss operations in which the valve is closed and closes the acoustic vent port (e.g., vent port 120) when the device is far away from the user's ear or the speaker is in a speaker mode, it is contemplated that in some embodiments, even when one or both of these conditions are met, the valve may remain open until a pressure input is detected. In other words, the valve could be in a default open position, even when the device is considered far from the user's ear or in a speaker mode, and then closed when a pressure input on the device, which could potentially compromise the speaker performance (e.g., distort the acoustic output), is detected, as will now be discussed in reference to FIG. 6.

Figure 6:
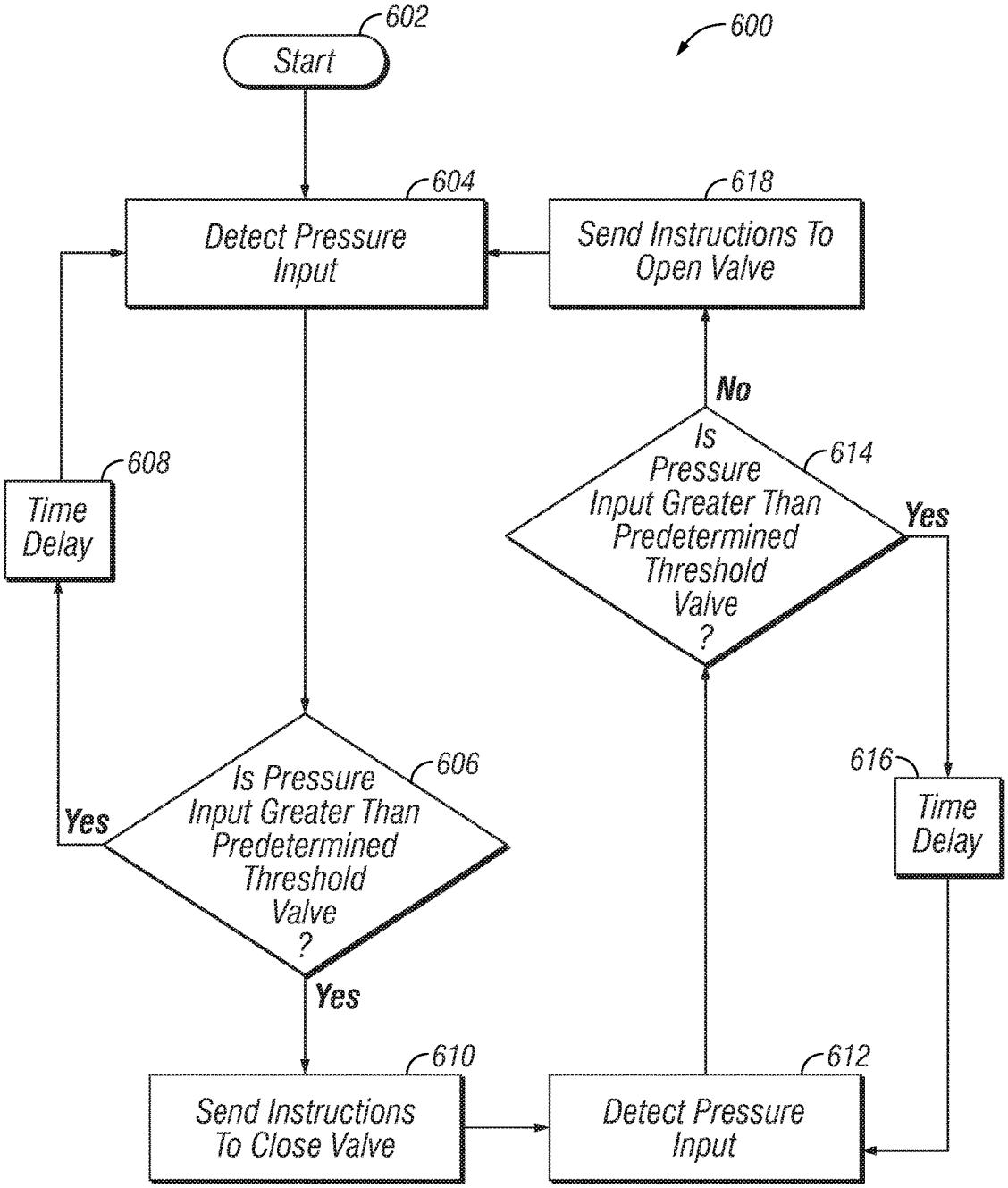
FIG. 6 is a simplified logic flow chart of another illustrative mode of operation for transitioning a valve between an open position and a closed position.

FIG. 6 is a simplified logic flow chart of an illustrative mode of operation for transitioning a valve between an open position and a closed position based on whether a pressure input to the device is detected. In this embodiment, operation of the valve (e.g., valve 124) may include process 600, which represents one embodiment for a processing unit that determines when to open and close the valve.

Process 600 can start at step 602 and proceed to step 604. In step 604, a determination is made as to whether a pressure input on the device (e.g., an enclosure 102 of device 100) is detected. The pressure input may be detected by, for example, a pressure sensor within the device (e.g., pressure sensor 128). The pressure sensor may be designed to detect, for example, a user pressing on the cover of the device enclosure in such a manner that it increases a pressure within an interior chamber or volume of the device enclosure. The detected information can be received, for example, by a processor within the device that then uses the information to determine the degree of pressure input. For example, in step 606, the processor can compare the information to predetermined pressure threshold data, and if based on the information, it is determined that the pressure input on the device is below the predetermined pressure level (e.g., a level which could potentially effect the speaker performance), the system can proceed to step 608. In step 608, process 600 can wait for a pre-determined time delay. After the pre-determined time delay, process 600 can return to step 604 and once again detect the pressure input. Thus, process 600 can repeatedly loop through steps 604, 606 and 608 until it is detected that the device is above the predetermined pressure threshold.

In response to a pressure input above the predetermined threshold level, process 600 can proceed to step 610 and send instructions to close the valve, and isolate the speaker back volume chamber (e.g., back volume chamber 116) from the enclosure interior chamber (e.g., interior chamber 106). This will in turn, isolate the speaker from the pressure change within the interior chamber of the enclosure, and therefore prevent any potential distortions in speaker output. For example, the instructions can be sent to a valve control unit located within the device.

After the valve is closed, process 600 can proceed to step 612 and can once again detect a pressure input. Steps 614, 616, and 618 can operate in the same manner as steps 604, 606 and 608 and can continue to loop and repeat, except since the valve is already closed, in step 618, instructions to open the valve are sent when it is determined that the pressure input is not greater than a predetermined threshold value (e.g., the pressure level will not effect the speaker if the valve is open). For example, in step 612 a pressure input is detected and in step 614, process 600 can determine if the pressure level is above the predetermined threshold level. In response to the pressure input being above the threshold level, process 600 can proceed to step 616 and wait for a pre-determined time delay, and can then return to step 612. Thus, as long as it is determined that the pressure input is greater than the predetermined threshold level, steps 612, 614 and 616 can continue to loop and the valve can remain closed. In response to it being determined that the detected pressure input is below the threshold, process 600 can proceed to step 618 and send instructions to open the valve.

Process 600 can then return to step 604 and once again repeat steps 604, 606, and 608, until a pressure input on the device is determined to be above a threshold level. In this manner, process 600 can continuously monitor the pressure input, and, in turn, provide data for automatically transitioning the valve between the open and closed positions. Process 600 can continue to operate as long as the system is on. For example, process 600 can continue to operate until the device is turned off. In addition, it should be understood that although a pressure input above or below a predetermined threshold pressure value is disclosed in process 600 as being used to determine whether to open or close the valve, in other embodiments, the presence or absence of the pressure input may be used to determine whether to open or close the valve. For example, if in step 604 a pressure input is detected, process 600 can proceed directly to step 610 and send instructions to close the valve. If, however, in step 604 a pressure input is not detected, process 600 can proceed directly to step 618 and send instructions to open the valve, or if the valve is already open, the valve can remain open.

It should further be understood that in addition to, or instead of, a device position (e.g., near or far from a user), mode of the speaker (e.g., speaker mode or receiver mode) or pressure input, audio signal processing may be used to determine whether to open or close the valve. Moreover, audio signal conditioning may further take place depending on whether valve is in an open position or closed position (e.g., a different EQ applied when valve is open than when closed, audio tuning, etc.)

Figure 7:
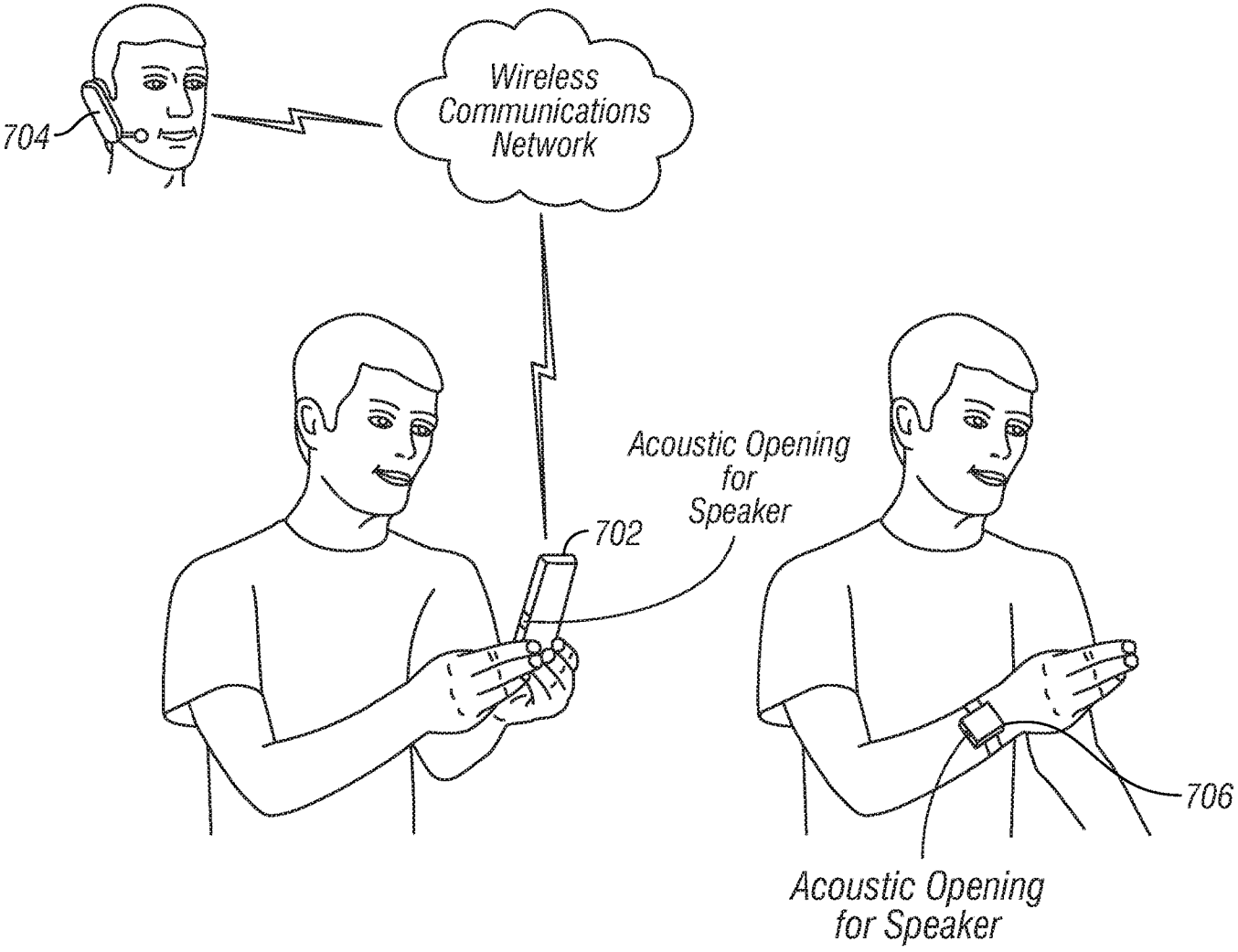
FIG. 7 illustrates one embodiment of a simplified schematic view of embodiments of electronic devices in which the speaker of FIG. 1 may be implemented

FIG. 7 illustrates one embodiment of a simplified schematic view of embodiments of electronic devices in which a speaker and valve, such as that described herein, may be implemented. As seen in FIG. 7, the speaker may be integrated within a consumer electronic device 702 such as a smart phone with which a user can conduct a call with a far-end user of a communications device 704 over a wireless communications network; in another example, the speaker may be integrated within the housing of a portable timepiece 706. These are just two examples of where the transducer described herein may be used, it is contemplated, however, that the speaker may be used with any type of electronic device in which a speaker is desired, for example, a tablet computer, a computing device or other display device.

Figure 8:
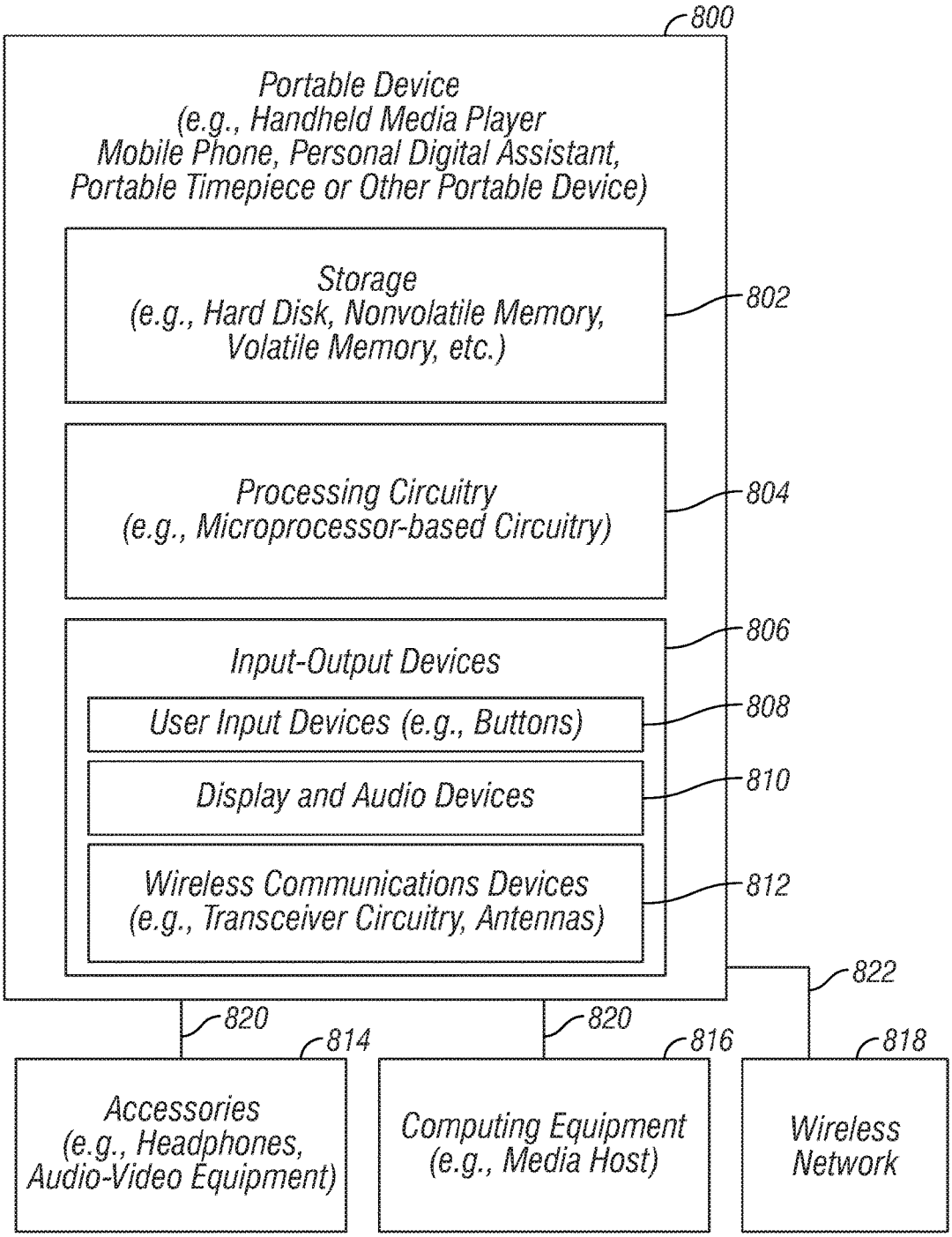
FIG. 8 illustrates a block diagram of one embodiment of an electronic device within which the speaker of FIG. 1 may be implemented.

FIG. 8 illustrates a block diagram of one embodiment of an electronic device within which the previously discussed speaker may be implemented. As shown in FIG. 8, device 800 may include storage 802. Storage 802 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 804 may be used to control the operation of device 800. Processing circuitry 804 may be based on a processor such as a microprocessor and other suitable integrated circuits. With one suitable arrangement, processing circuitry 804 and storage 802 are used to run software on device 800, such as internet browsing applications, voice-over-internet-protocol (VOIP) telephone call applications, email applications, media playback applications, operating system functions, etc. Processing circuitry 804 and storage 802 may be used in implementing suitable communications protocols. Communications protocols that may be implemented using processing circuitry 804 and storage 802 include internet protocols, wireless local area network protocols (e.g., IEEE 802.11 protocols—sometimes referred to as Wi-Fi®), protocols for other short-range wireless communications links such as the Bluetooth® protocol, protocols for handling 3G or 4G communications services (e.g., using wide band code division multiple access techniques), 2G cellular telephone communications protocols, etc.

To minimize power consumption, processing circuitry 804 may include power management circuitry to implement power management functions. For example, processing circuitry 804 may be used to adjust the gain settings of amplifiers (e.g., radio-frequency power amplifier circuitry) on device 800. Processing circuitry 804 may also be used to adjust the power supply voltages that are provided to portions of the circuitry on device 800. For example, higher direct-current (DC) power supply voltages may be supplied to active circuits and lower DC power supply voltages may be supplied to circuits that are less active or that are inactive. If desired, processing circuitry 804 may be used to implement a control scheme in which the power amplifier circuitry is adjusted to accommodate transmission power level requests received from a wireless network.

Input-output devices 806 may be used to allow data to be supplied to device 800 and to allow data to be provided from device 800 to external devices. Display screens, microphone acoustic ports, speaker acoustic ports, and docking ports are examples of input-output devices 806. For example, input-output devices 806 can include user input-output devices 808 such as buttons, touch screens, joysticks, click wheels, scrolling wheels, touch pads, key pads, keyboards, microphones, cameras, etc. A user can control the operation of device 800 by supplying commands through user input devices 808. Display and audio devices 810 may include liquid-crystal display (LCD) screens or other screens, light-emitting diodes (LEDs), and other components that present visual information and status data. Display and audio devices 810 may also include audio equipment such as speakers and other devices for creating sound. Display and audio devices 810 may contain audio-video interface equipment such as jacks and other connectors for external headphones and monitors.

Wireless communications devices 812 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications). Representatively, in the case of a speaker acoustic port as shown in FIG. 7, the speaker may be associated with the port and be in communication with an RF antenna for transmission of signals from the far end user to the speaker.

Returning to FIG. 8, device 800 can communicate with external devices such as accessories 814, computing equipment 816, and wireless network 818 as shown by paths 820 and 822. Paths 820 may include wired and wireless paths. Path 822 may be a wireless path. Accessories 814 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 816 may be any suitable computer. With one suitable arrangement, computing equipment 816 is a computer that has an associated wireless access point (router) or an internal or external wireless card that establishes a wireless connection with device 800. The computer may be a server (e.g., an internet server), a local area network computer with or without internet access, a user's own personal computer, a peer device (e.g., another portable electronic device), or any other suitable computing equipment.

Wireless network 818 may include any suitable network equipment, such as cellular telephone base stations, cellular towers, wireless data networks, computers associated with wireless networks, etc. For example, wireless network 818 may include network management equipment that monitors the wireless signal strength of the wireless handsets (cellular telephones, handheld computing devices, etc.) that are in communication with network 818.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although a speaker is specifically disclosed herein, the valve disclosed herein could be used with other types of transducers, for example, microphones. Still further, although a portable electronic device such as a mobile communications device is described herein, any of the previously discussed valve and transducer configurations may be implemented within a tablet computer, personal computer, laptop computer, notebook computer and the like. The description is thus to be regarded as illustrative instead of limiting.

What is claimed is:

1. A portable electronic device comprising:

an enclosure having an enclosure wall that forms an interior chamber and an acoustic port to an ambient environment;

a speaker module positioned within the interior chamber, the speaker module having a speaker and a module wall forming a front volume chamber acoustically coupling a sound output side of the speaker to the acoustic port and forming a back volume chamber around a back side of the speaker, wherein the back volume chamber comprises an acoustic vent port formed through the module wall to acoustically couple the back volume chamber to the interior chamber; and an electromechanical valve for regulating the acoustic coupling of the back volume chamber to the interior chamber, wherein the electromechanical valve is in an open configuration when the speaker is closer to a user's ear, in the open configuration the acoustic vent port is open to the interior chamber, and the electromechanical valve is in a closed configuration when the speaker is farther from a user's ear, in the closed configuration the acoustic vent port is closed off from the interior chamber.

2. The portable electronic device of claim 1 wherein the speaker is in a receiver mode when the speaker is closer to the user's ear and a speaker mode when the speaker is farther from the user's ear, and the electromechanical valve automatically transitions between the open configuration and the closed configuration based on whether the speaker is in the receiver mode or the speaker mode.

3. The portable electronic device of claim 1 wherein the device further comprises a proximity sensor for detecting a proximity of the speaker to a user's ear, and the electromechanical valve automatically transitions between the open configuration and the closed configuration based on the proximity of the speaker to the user's ear.

4. The portable electronic device of claim 1 wherein the device further comprises a pressure sensor for detecting a pressure input on the enclosure, and the electromechanical valve is operable to transition between the open configuration and the closed configuration based on the detecting of the pressure input.

5. The portable electronic device of claim 4 wherein the electromechanical valve is in the open configuration when the pressure input is below a predetermined pressure input threshold value and transitions to the closed configuration when the pressure input is above the predetermined pressure input threshold value.

6. The portable electronic device of claim 1 wherein the electromechanical valve is a piezoelectric valve.

7. The portable electronic device of claim 1 wherein the electromechanical valve is an electroactive polymer actuated valve.

8. The portable electronic device of claim 1 wherein the enclosure is a mobile communications device enclosure or a portable time piece enclosure.

9. A portable electronic device comprising:

an enclosure having an enclosure wall that forms an interior chamber, and the interior chamber is sealed from a surrounding environment outside of the enclosure wall;

a speaker module positioned within the interior chamber, the speaker module having a speaker and a module wall forming a back volume chamber of the speaker, wherein the back volume chamber comprises an acoustic vent port formed through the module wall to acoustically couple the back volume chamber to the interior chamber; and a valve for regulating the acoustic coupling of the back volume chamber to the interior chamber depending on whether the speaker is in a receiver mode or a speaker mode, wherein in the receiver mode, the speaker is closer to a user's ear, the valve is in an open configuration and the acoustic vent port is open to the interior chamber, and in the speaker mode, the speaker is farther from a user's ear, the valve is in a closed configuration and the acoustic vent port is closed to the interior chamber.

10. The portable electronic device of claim 9 wherein the valve is electromechanically actuated.

11. The portable electronic device of claim 9 wherein the valve is a piezoelectric valve.

12. The portable electronic device of claim 9 wherein the valve comprises a piezoelectric member coupled to a valve flap by a flexure linkage, and the valve flap is aligned with the acoustic vent port.

13. The portable electronic device of claim 12 wherein application of a voltage to the piezoelectric member drives movement of the valve flap between the open configuration and the closed configuration, wherein in the open configuration.

14. The portable electronic device of claim 9 wherein the valve comprises an electroactive polymer operable to actuate the valve to move between an open configuration and a closed configuration.

15. The portable electronic device of claim 9 wherein the valve is bistable.

16. The portable electronic device of claim 9 wherein in the receiver mode, the speaker is closer to a user's ear than in the speaker mode.

17. The portable electronic device of claim 9 wherein the device further comprises a proximity sensor to detect whether the speaker is in the receiver mode or the speaker mode based on a proximity of the speaker to a user's ear, and the valve transitions between the open configuration and the closed configuration based on the detection of the receiver mode or the speaker mode by the proximity sensor.

18. A portable electronic device comprising:

an enclosure having an enclosure wall that forms an interior chamber;

a speaker module positioned within the interior chamber, the speaker module having a speaker and a module wall forming a back volume chamber of the speaker, wherein the back volume chamber comprises an acoustic vent port formed through the module wall to acoustically couple the back volume chamber to the interior chamber;

a valve for regulating the acoustic coupling of the back volume chamber to the interior chamber based on a pressure input to a surface of the enclosure wall, wherein the valve is operable to transition between an open configuration in which the interior chamber is open to the back volume chamber and a closed configuration in which the interior chamber is closed to the back volume chamber; and a pressure sensor operable to detect a pressure change within the interior chamber that is caused by the pressure input to the enclosure wall, and wherein the valve transitions to the closed configuration when the pressure change is detected and the open configuration when the pressure change is not detected.

19. The portable electronic device of claim 18 wherein the speaker is a micro-speaker.

* * * * *